US005656788A

United States Patent [19]

Wise

[11] Patent Number: 5,656,788

[45] Date of Patent: Aug. 12, 1997

[54] TROMBONE GUIDE

[75] Inventor: Philip C. Wise, Joplin, Mo.

[73] Assignee: G. Leblanc Corporation, Kenosha, Wis.

[21] Appl. No.: 587,629

[22] Filed: Jan. 17, 1996

[51] Int. Cl.[6] ..... G10D 7/10

[52] U.S. Cl. ..... 84/395; 84/387 A

[58] Field of Search ..... 84/395, 453, 387 A

[56] References Cited

U.S. PATENT DOCUMENTS 959,033 5/1910 Summers ..... 84/395

1,255,766 2/1918 Martens ..... 84/395

1,385,202 7/1921 Couturiers ..... 84/395

3,834,268 9/1974 McCracken ..... 84/453

*Primary Examiner*—Cassandra C. Spyrou

*Attorney, Agent, or Firm*—Trexler, Bushnell, Giangiorgi & Blackstone, Ltd.

[57] ABSTRACT

The trombone guide of the present invention provides a novel guide for positioning the first and second finger and thumb of the trombonist to ensure proper slide technique.

4 Claims, 1 Drawing Sheet

TROMBONE GUIDE

BACKGROUND OF THE INVENTION

The present invention relates to a trombone guide and more specifically to a novel guide for use in positioning the trombonist's hand to ensure correct slide technique.

The correct finger/hand position has long been known by most music educators. Yet, most young trombonists will do it wrong.

Accordingly, a general object of the present invention is to provide a novel trombone guide for positioning the thumb and first two fingers of a trombonist on the slide bracing of the trombone to ensure correct slide technique.

Another object of the present invention is to provide a novel trombone guide which is easy and economical to manufacture.

A more specific object of the present invention is to provide a trombone guide that can be easily releasably attached to a portion of the slide bracing of the trombone which includes separate contoured portions for positioning the thumb and first two fingers of the trombonist to ensure correct slide technique.

SUMMARY OF THE INVENTION

A musical trombone guide which is releasably attachable to a portion of the trombone slide bracing to require a musician to place their first two fingers and thumb in the correct place for proper hand/slide position. This correct fingering/hand position allows the trombonist correct slide technique.

BRIEF DESCRIPTION OF THE DRAWINGS

Features of the present invention which are believed to be novel are set forth with particularity in the appended claims. The organization and manner of the operation of the invention, together with further objects and advantages thereof, may best be understood by reference to the following description taken in connection with the accompanying drawings in which:

DETAILED DESCRIPTION OF THE PREFERRED EMBODIMENT

Figure 1:
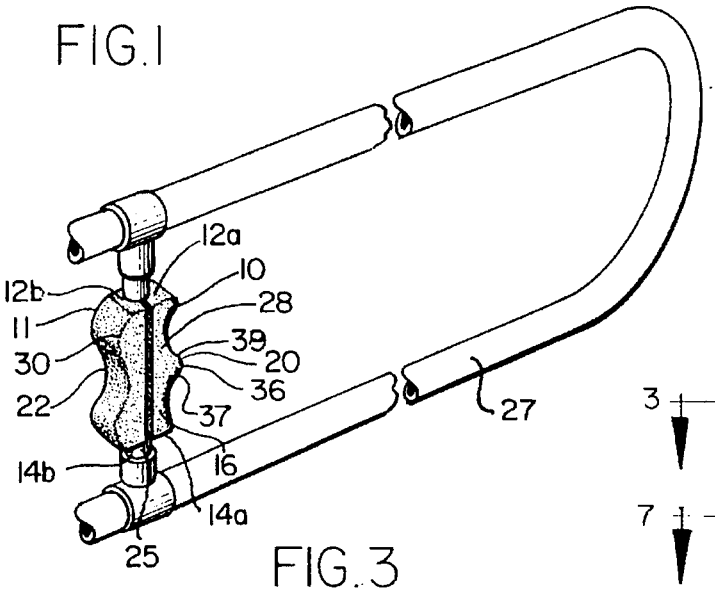
FIG. 1 is a fragmentary perspective view of the trombone guide incorporating the features of the present invention mounted on a slide.

Turning to the drawings when like components are designated by like reference numerals through the various figures, a trombone guide, constructed in accordance with the present invention is illustrated in FIGS. 1–7 and generally designated by reference numeral 10.

It is to be noted that the trombone guide 10, is preferably made of a one-piece molded flexible rubber or plastic material. The trombone guide 10, has a body 11. The body 11, has a top end 12, bottom end 14, a front 16, backside 18, a right or first side 20 and a left or second side 22.

As shown in FIGS. 2–7, the body of the guide 10, also includes a hollow aperture 24 which extends from the top end 12 to the bottom end 14 of the guide. The hollow aperture has a predetermined circumference for releasably receiving a portion of a cross brace 25 of a trombone slide 27.

Figure 2:
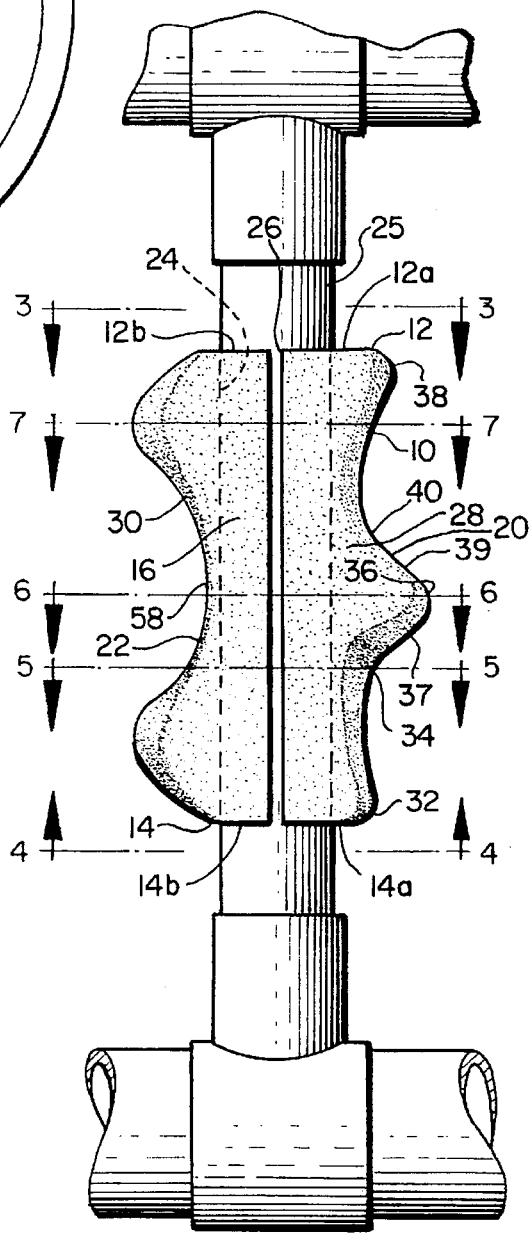
FIG. 2 is an enlarged side elevational view of a portion of FIG. 1.
Figure 3:
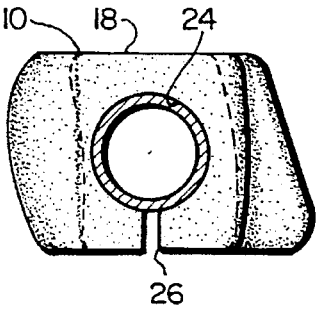
FIG. 3 is a sectional view taken along lines 3—3 of FIG. 2 showing the top end of the trombone guide.
Figure 4:
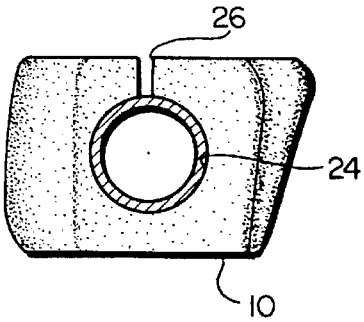
FIG. 4 is a sectional view taken along lines 4—4 showing the bottom end of the trombone guide.

As shown best in FIG. 2, the front 16 of the guide 10 includes a slit 26 which extends from the top portion of the guide 12 to the bottom portion of the guide 14 and intersects the aperture or bore 24. As set forth above, the slit 26 extends from the top 12 to the bottom 14 of the guide thereby splitting the front 16 of the guide 10 into a right portion 28 and a left portion 30.

The guide 10 is made of a material capable of resiliently flexing or expanding so that the front portions 28 and 30 of the guide 10 can be pulled apart or expanded at slit 26 so that side portions 28 and 30 are spread apart far enough to slop over the brace 25 and to snap back and wrap around a portion of the brace 25 when said sides are released by the user.

As shown in FIGS. 1 & 2, the guide 10, is positioned so that the slit 26 is centered between a first and second side of the trombone bracing slide so that the right side 20 is positioned towards the outer end of the trombone slide and the left side 22 is positioned toward the musician.

The top end 12 is split into a right top end 12A and left top end 12B by slit 26 and the bottom end 14 is split into a right end 14A and a left end 14B.

Figure 5:
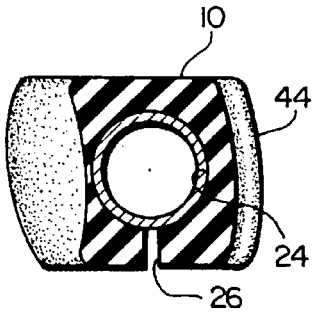
FIG. 5 is a sectional view taken along lines 5—5 of FIG. 2.
Figure 6:
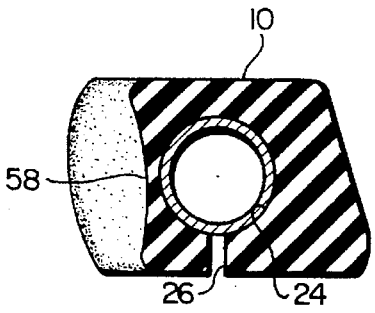
FIG. 6 is a sectional view taken along lines 6—6 of FIG. 2.
Figure 7:
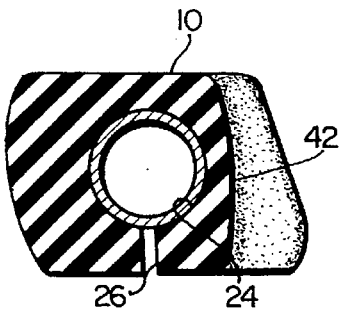
FIG. 7 is a sectional view taken along lines 7—7 of FIG. 2.

The right side 14A of end wall 14 is substantially straight and has a rounded end 32. As shown best in FIGS. 1 & 2, the right side 20 gradually slopes downward until it reaches point 34 as shown in FIG. 2 and FIG. 5. From point 34 the right side 20 sharply inclines to mid-point 36. The area between point 34 and mid-point 36 form first finger guide wall 37. The right side 12A of top wall 12 is substantially straight and has rounded end or corner 38. The right side slopes downwardly from end 38 until point 40 and then sharply inclines to mid-point 36. The area between points 40 and 36 form second finger guide wall 39. The area between first finger guide wall 37 and second finger guide wall 39 forms a partition or divider 45 between first finger guide 42 and second finger guide 44. The area between end 32 and 36 forms first finger guide member or first contoured portion 42 and the second contoured area between end 38 and mid-point 36 forms second finger guide member or second contoured portion 44.

The left side 14B of end wall 14 has a substantially straight section 46 of a predetermined length and then has a contoured end wall 48 and rounded corner or point 50. The left side 12B of top wall 12 also has a substantially straight portion 52 and a contoured end wall 54 and rounded corner point 56. From rounded end point 50 to 56, the left side 22 is substantially contoured forming a single thumb guide member 58.

In other words, the finger guide surfaces or walls 42 and 44 are contoured so that each has a generally concave configuration in a vertical direction. At the same time, each wall or surface 42 and 44 has a generally convex configuration in a transverse or horizontal direction for conforming to the shape of a musician's fingers. The opposite or thumb guide surface 58 or wall is contoured so that it also has a generally concave configuration in a vertical direction, but this guide surface 58 is shaped so that it also has a generally concave configuration in the transverse or horizontal direction so as to conform to the shape of the musician's thumb. It is noted that the divider 45 between the finger guide surfaces 42 and 44 is generally aligned with a mid-point of the thumb guide surface 58 so that the fingers, when placed on the guide, will respectively be slightly above and below the thumb.

When using the guide, a musician places his first finger of his left or right hand in first finger guide 44 and his second finger in second finger guide 42 and his thumb in thumb guide 58. By placing the thumb in the thumb guide 58 and the first two fingers in guides 42 and 44, respectively, the trombonist's fingers are in the correct place for proper hand/slide position so that the wrist is now being used to move the slide rather than the elbow or arm. This positioning allows the performer the correct slide technique which will ultimately enable the trombonist to properly play the trombone.

I claim:

1. A guide for positioning fingers on a moveable slide brace which is attached to the moveable slide portion of a trombone slide, said guide comprising a body having means for releasably attaching to said moveable slide brace, said body having a right side facing an outer end of the trombone slide and a left side facing the trombonist, said right side including vertically separate first and second finger guides having a concave configuration in a vertical direction for positioning said trombonist's first and second fingers on one hand and said left side including a concave thumb guide for positioning said trombonist's thumb, said first concave finger guide is separated from said second concave finger guide by a divider wall for positioning said trombonist's first and second fingers on one hand, said divider wall being aligned with approximately a mid-point of said thumb guide so that the fingers when placed on the first and second finger guides will respectively be slightly above and below the thumb.

2. A guide for positioning fingers on a moveable slide brace which is attached to the moveable slide portion of a trombone slide, said guide comprising a body having an aperture therethrough for releasably retaining a portion of said moveable slide brace, a top end and a bottom end and a first side and a second side, said first side including a first and a second contoured portion separated by a divider wall for positioning said trombonist's first and second fingers and said left side including a thumb guide for positioning said trombonist's thumb, said first and second finger guides being contoured so each has a generally concave configuration in a vertical direction and a generally convex configuration in a transverse direction for conforming to the shape of the trombonist's fingers, said thumb guide being contoured so that it has a concave configuration in a vertical direction and a concave configuration in a transverse direction so as to conform to the trombonist's thumb, said divider wall between said first and second finger guide is aligned so that said first and second fingers, when placed on the guide, will be respectively above and below the thumb.

3. A guide of claim 2 wherein said body includes a top end and a bottom end and a front and a back and an aperture extending from said top end of said guide to said bottom end of said guide and a slit which intersects said aperture separating said front side of said guide for releasably retaining a portion of said moveable slide brace.

4. A guide for positioning fingers on a movable slide brace which is attached to the moveable slide portion of a musical instrument slide, the removable slide portion telescopically moving on a corresponding tube portion of the musical instrument, said guide comprising a body of resilient material having a front portion, a back portion, a first side and a second side and an aperture extending from a top end of said body to a bottom end of said body, said front portion of said body having a slit intersecting said aperture separating said front side of said guide for releasably retaining a portion of said moveable slide brace, said first side of said guide including vertically separate first and second finger guides having a concave configuration in a vertical direction and a convex configuration in a transverse direction conforming to the shape of the musician's first and second fingers, said second side having a concave configuration in a transverse direction to conform to the musician's thumb and located on said body to position the musician's thumb generally opposite and spaced between said first and second fingers.

* * * * *